US005655497A

United States Patent [19]

Nakajima

[11] Patent Number: 5,655,497

[45] Date of Patent: Aug. 12, 1997

[54] INDUCTION SYSTEM FOR MOTORCYCLE

[75] Inventor: Akitoshi Nakajima, Iwata, Japan

[73] Assignee: Yamaha Hatsudoki Kabushiki Kaisha, Iwata, Japan

[21] Appl. No.: 706,847

[22] Filed: Sep. 3, 1996

[30] Foreign Application Priority Data

Sep. 11, 1995 [JP] Japan ..... 7-232237

[51] Int. Cl.[6] ..... F02B 77/00

[52] U.S. Cl. ..... 123/198 E; 55/385.3

[58] Field of Search ..... 123/198 E; 55/385.3, 55/DIG. 28; 180/219

[56] References Cited

U.S. PATENT DOCUMENTS 4,648,474 3/1987 Shinozaki et al. ..... 55/385.3

FOREIGN PATENT DOCUMENTS 3518076 11/1985 Germany ..... 55/385.3

*Primary Examiner*—Noah P. Kamen

*Attorney, Agent, or Firm*—Knobbe, Martens, Olson & Bear LLP

[57] ABSTRACT

A motorcycle and specifically an improved compact air inlet device and filter assembly for a motorcycle. The air inlet device is provided with a relatively large volume but an irregular shape to permit positioning in the area over the engine and beneath the fuel tank. By utilizing a horseshoe-shaped filter element, however, a large filter surface area may be achieved so as to reduce service intervals and to ensure that the engine will operate without flow restriction for a long period of time even if the filter element is not serviced.

22 Claims, 6 Drawing Sheets

INDUCTION SYSTEM FOR MOTORCYCLE

BACKGROUND OF THE INVENTION

This invention relates to an induction system for a motorcycle and more particularly to an improved, compact, high-efficiency, air inlet device and filter arrangement for such vehicles.

Motorcycles like many other forms of motor vehicles powered by internal combustion engines provide substantial design challenges for the engineer. One area that is particularly important to the performance of an engine is the design and configuration of the air induction system for the engine. It is generally the practice to provide some form of air inlet device through which the atmospheric air is collected and delivered to the intake ports of the engine. Normally with most applications, a filter element is contained within this air inlet device.

Because of the extremely compact nature of motorcycles, the design and configuration of optimal air inlet devices is quite a problem. Frequently, the engine is positioned in the frame in an area below the fuel tank. If the engine is configured so that the induction system must be served through upwardly extending passages, scant room is available for the air inlet device.

For a variety of reasons, however, it is desirable to maintain relatively large air inlet devices. Also, it is important that the filter element be constructed and configured in such a way that it has a relatively large flow area. Unless the filter element is provided with a large flow area frequent servicing will be required. In addition, the filter element can quickly become restricted and the performance of the engine deteriorates significantly unless large areas are provided.

It is, therefore, a principal object of this invention to provide an improved air inlet device for a motor vehicle such as a motorcycle.

It is a further object of this invention to provide an improved and yet compact air inlet device and filter for a motorcycle.

It is a still further object of this invention to provide an air inlet device and filter for a motorcycle wherein a large effective cross-sectional area is provided for the flow through the filter element but wherein the overall volume of the air inlet device can be maintained quite compact.

SUMMARY OF THE INVENTION

This invention is adapted to be embodied in an air inlet device for an internal combustion engine. The engine has a pair of spaced apart inlet sections. The air inlet device is comprised of an outer housing which defines an outlet section in part by a lower wall that has a pair of spaced apart discharge openings that communicate with the engine inlet sections. The lower wall is surrounded by an upstanding vertical wall to define a generally rectangular shape volume in top plan view. An air inlet opening is formed in an air inlet section in the outer housing which is in spaced relationship to the outlet section and which receives atmospheric air. A filter element is contained within the outer housing and has an arcuate filter section that divides the inlet section from the outlet section of the outer housing for air flow through the filter element from the inlet section to the outlet section.

DETAILED DESCRIPTION OF THE PREFERRED EMBODIMENTS OF THE INVENTION

Figure 1:
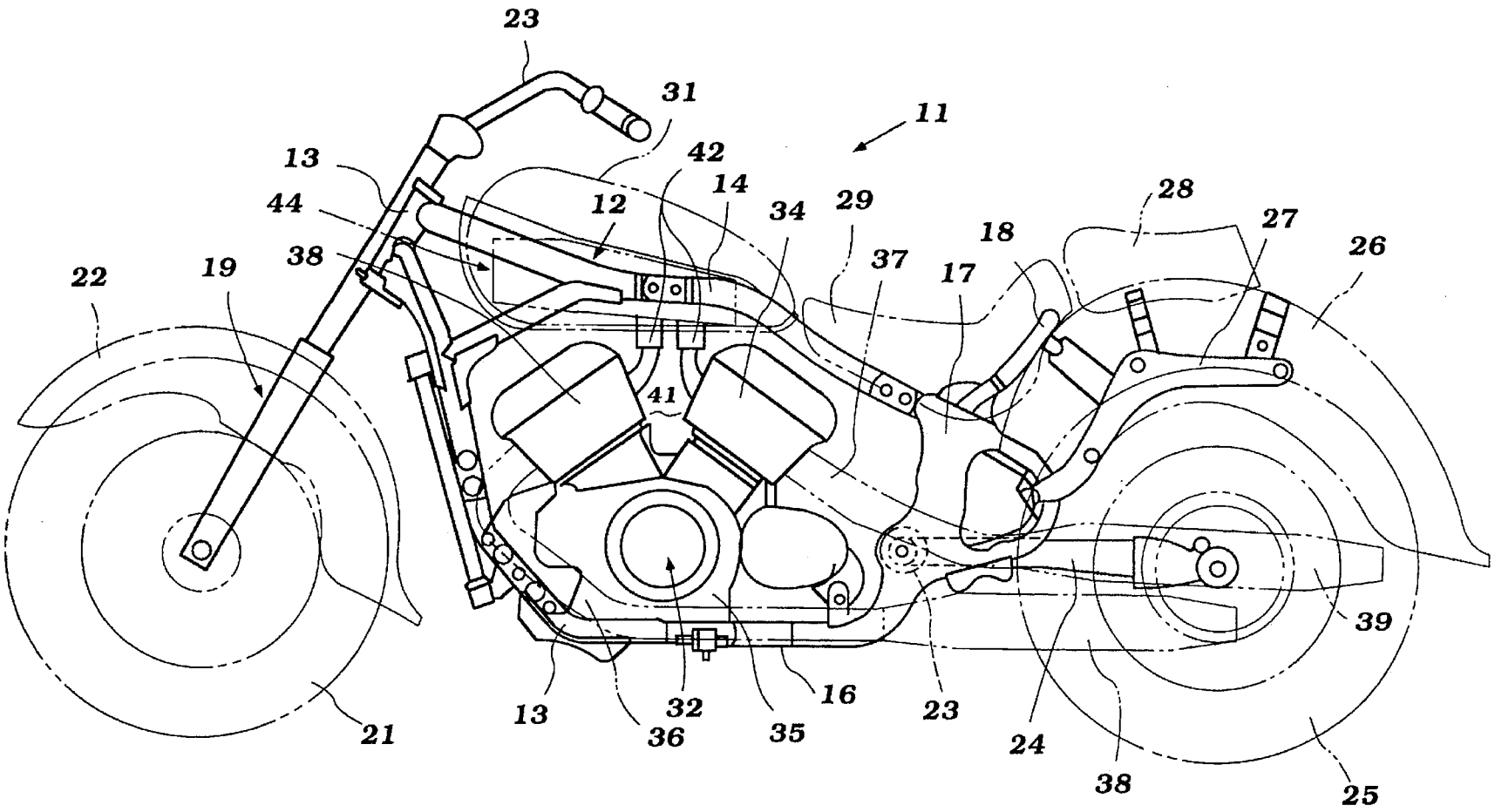
FIG. 1 is a side elevational view of a motorcycle constructed in accordance with an embodiment of the invention with certain portions of the motorcycle being shown in phantom so as to more clearly illustrate the air inlet device that forms the subject matter of the invention.

Referring now in detail to the drawings and initially to FIG. 1, a motorcycle embodying the invention is indicated generally by the reference numeral 11. As should be apparent from the foregoing description, the invention has particular utility in conjunction with a motorcycle such as the motorcycle 11 because of the extreme space constraints presented by such vehicles. It will be understood, however, by those skilled in the art that certain facets of the invention may be employed in conjunction with other applications for engines than motorcycles. However, the invention does have particular utility in conjunction with such applications.

The motorcycle 11 is comprised of a frame assembly, indicated generally by the reference numeral 12. This frame assembly includes a head pipe 13 from which a pair of main frame tubes 14 extend downwardly and rearwardly. In addition, a pair of down tubes 15 extend downwardly and rearwardly from the head pipe 13 toward the lower portion of the motorcycle 11 and in generally parallel relationship to the main tubes 14. The lower ends of the down tubes 15 are joined to horizontally extending lower tubes 16 which extend rearwardly and terminate in an area where they are joined to a pair of assemblies 17, which may comprise castings or fabrications, one at each side of the frame 12. The main tubes 14 are also joined to the upper ends of these assemblies 17. The assemblies 17 at each side of the motorcycle are joined to each other by a plurality of reinforcing members such as a cross tube 18.

A front fork assembly 19 is dirigibly supported by the head pipe 13 in any well-known manner. A front wheel 21 is journaled at the lower end of the front fork assembly 19 and is at least partially covered by a fender 22. A handlebar assembly 23 is connected to the upper end of the front fork 19 for steering of the front wheel 21 in a well-known manner.

The assemblies 17 each provide a pair of respective pivot points 23 to provide a pivotal connection for a trailing arm assembly 24. The pivotal movement of the trailing arm assembly 24 relative to the frame 12 is controlled by any suitable type of suspension mechanism. A rear wheel 25 is rotatably journaled at the rear end of the trailing arm 24 and is covered in part by a rear fender 26.

The rear fender 26 is supported in part by means of a pair of seat brackets 27 that are affixed to the assemblies 17 and which carry cross braces that support both a passenger seat 28 and the rear portion of the rider or operator's seat 29. As may be seen in FIG. 2, the main tubes 14 are bowed in in the area of the rider's seat 29 so as to provide a comfortable riding position for the rider without sacrificing the strength of the frame assembly.

A fuel tank 31 is mounted on the main frame tubes 14 to the rear of the head pipe 13 and forwardly of the seat 29. This fuel tank has a generally inverted saddle shape so as to provide a clearance for a reason which will be described.

The construction of the motorcycle 11 as thus far described may be considered to be conventional for the purposes of this description. The foregoing description is merely to permit those skilled in the art to understand the problems attendant with the design and location of certain components as will become apparent. Therefore, where any details of the motorcycle construction either to this point or later are not incorporated or illustrated, any known structure may be utilized.

The rear wheel 25 is driven by an internal combustion engine, indicated generally by the reference numeral 32 and which is mounted in the frame assembly 12 beneath the fuel tank 31 and cradled between the down tubes 19, horizontal tubes 16 and main tubes 14. In the illustrated embodiment, the engine 32 is of the V-twin type which is mounted so as to provide a forwardly inclined cylinder bank 33 and a rearwardly inclined cylinder bank 34 each of which contains at least one cylinder. Although the invention is described in conjunction with a V-2 engine, it will be readily apparent to those skilled in the art how the invention can be practiced with engines having other cylinder numbers. The invention also may be utilized with in-line type of engines but does have particular utility in conjunction with V-type engines that are disposed so that their crankshaft rotates transversely to the longitudinal center line of the motorcycle.

As is typical with motorcycle practice, the engine output shaft or crankshaft rotates within a crankcase, transmission assembly 35 that incorporates, in addition to the crankcase, a change speed transmission for driving the rear wheel 25 in a suitable manner such as via a chain or drive shaft.

A pair of exhaust manifolds 36 and 37 convey the exhaust gases from the outer peripheral portions of the front and rear cylinder banks 33 and 34, respectively, and discharge the exhaust gases at one side of the rear wheel to the atmosphere through tail pipes and mufflers 38 and 39, respectively.

Figure 2:
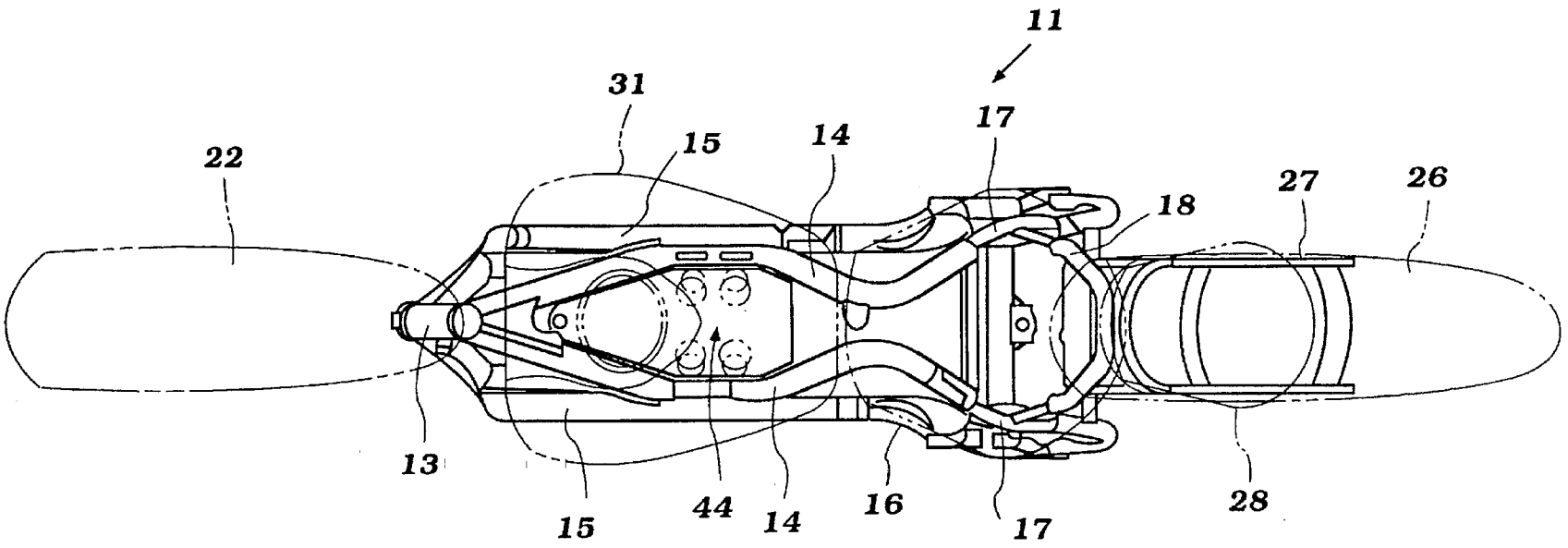
FIG. 2 is a top plan view of the motorcycle again with certain components shown in phantom those being primarily the same components that are illustrated in phantom in FIG. 1.

Continuing to refer now to FIGS. 1 and 2 but expanding the description to encompass the remaining figures, the engine 32 is provided with an induction system. In the illustrated embodiment, the engine 32 is provided with four valves per cylinder and this includes two intake valves for each cylinder of the engine which intake valves terminate in intake ports that are disposed in a valley, indicated by the reference numeral 41 that is disposed between the cylinder banks 33 and 34. A pair of dual throat carburetors 42 and 43 are mounted to relatively short intake manifolds 44 and 45, respectively that serve the intake ports of each of the cylinder banks 32 and 33. These carburetors 42 and 43 have their intake passages inclined so that they extend generally vertically upwardly at a relatively shallow angle to a vertical plane. It should be noted that although the invention is described in conjunction with two dual throat carburetors, it also may be employed with engines having single throat carburetors, one for each intake port of the cylinder head. For this reason, the actual construction of each carburetor is not particularly significant to the invention which deals primarily with the air inlet and filter device, indicated generally by the reference numeral 44 which supplies air to these carburetors 42 and 43.

Referring now in detail primarily to FIGS. 3 through 6, the air inlet device 44 will be described in more detail. It should be noted that the air inlet device 44 is configured so that it fits primarily into the recess formed in the lower wall of the fuel tank 31. As has been noted, the fuel tank 31 has a generally saddle shape.

Basically, the air inlet device 44 is comprised of an outer housing that is comprised of a lower member 45 and an upper member 46 which members are secured to each other detachably by means of a plurality of threaded fasteners 47. These housing members 45 and 46 are formed from a suitable material such as a molded resin or the like. The members 45 and 46 define an internal cavity through which air flows prior to the transfer to the carburetors 42 and 43.

It should be seen that the lower member 45 has, in the area over carburetor inlets 48, a V-inclined lower wall portion 49 that define openings that receive in sealing relationship the carburetor air inlets 48. The inclination of the lower wall 49 is such that the outer inlets 48 of the carburetors 42 and 43 extend generally perpendicularly through them. As may be seen best in FIG. 6, this area of the interior of the air inlet device, indicated generally by the reference numeral 51 is comprised of an outlet section to which the air is delivered through outlet passages 52 into the carburetor inlet openings 48. It will be seen that this lower wall is surrounded by a generally upstanding wall so as to provide a generally rectangular air outlet area in top plan view.

The rear portion of the upper closure member 46 of the air inlet device 45 is inclined in an upward forward direction so as to provide a volume that increases in the forward direction so as to provide a maximum height and also to utilize to a maximum the space available.

Moving now toward the front of the air inlet device 44, the lower wall formed by the lower member 45 is provided with a vertically extending air inlet passage 53 which extends generally perpendicularly upwardly through the lower wall. This portion of the lower wall of the housing member 45 is generally planar. The V-shaped rear wall portion 49 merges into this planar section. The planar section is utilized for a mason which will be described.

The lower wall 45 has a downwardly extending protuberance 54 that is in line with the vertically extending passage 53 and which defines a generally horizontally extending inlet section 55 that terminates at its rear end in an atmospheric air inlet opening 56. Hence, atmospheric air can be drawn into an inlet section 55 of the outer housing assembly 44 through the inlet opening 56. Since this air flows from a rearward direction forwardly, it will assist in ensuring that foreign objects are not ingested and also will provide adequate air flow. The section 53 is formed by an upwardly extending tubular wall 58 and thus the air that is drawn into the inlet section 55 will be delivered vertically toward the center of a housing inlet section 57.

An air filter assembly, indicated generally by the reference numeral 59 and of the removable cartridge type is supported within the inlet section 57 and in essence divides the inlet section 57 from the outlet section 51. The air filter assembly 59 is comprised of a lower shell 61 that is formed with a central opening 62 that encircles the tubular air inlet wall 58. A sealing gasket 63 is received around the lower wall 61 around the opening 62 so as to ensure against air leakage in this area.

The air filter assembly 59 further includes an upper wall forming member 64 that is held in spaced relationship to the lower wall 61 in part by a filter element 65. As may be best seen in FIG. 6, this filter element 65 has an arcuate and generally horseshoe shape. This shape actually terminates toward the rear end of the air inlet opening 53 with the remaining area being around the filter element 65 being sealed by an imperforate wall 66. Thus, the filter element 59 in essence provides a very large surface area in a very small physical space. Because of this, the filter element will need servicing only infrequently and large amounts of foreign particles can accumulate without restricting the flow therethrough in any substantial fashion.

The air filter element 59 is located in the lower housing piece by a pair of upstanding lugs 67 that are formed integrally in the lower wall of the member 45. In addition, lugs 68 are formed at the forward portion of the lower member 45 to also assist in the locating of the filter element 59 when the cover 46 is removed. Thus, the filter opening 62 will be aligned around the tubular section 58 formed by the lower wall.

The upper member 46 or cover of the outer housing is formed with a ridge 69 that engages an upstanding portion of the upper wall 64 of the filter element 59. Rearwardly and around the actual filter element 65, the upper member is formed with an arcuate wall 71 which also engages the filter element 59 and holds the seal 63 under compression to ensure good sealing.

The lower member 45 is formed with a plurality of bosses 72 that receive the threaded fasteners 47 so as to provide the detachable connection between the housing pieces 45 and 46 so as to facilitate servicing. These bosses 72 and fasteners 47 have different lengths in different areas as should be readily apparent.

Figure 3:
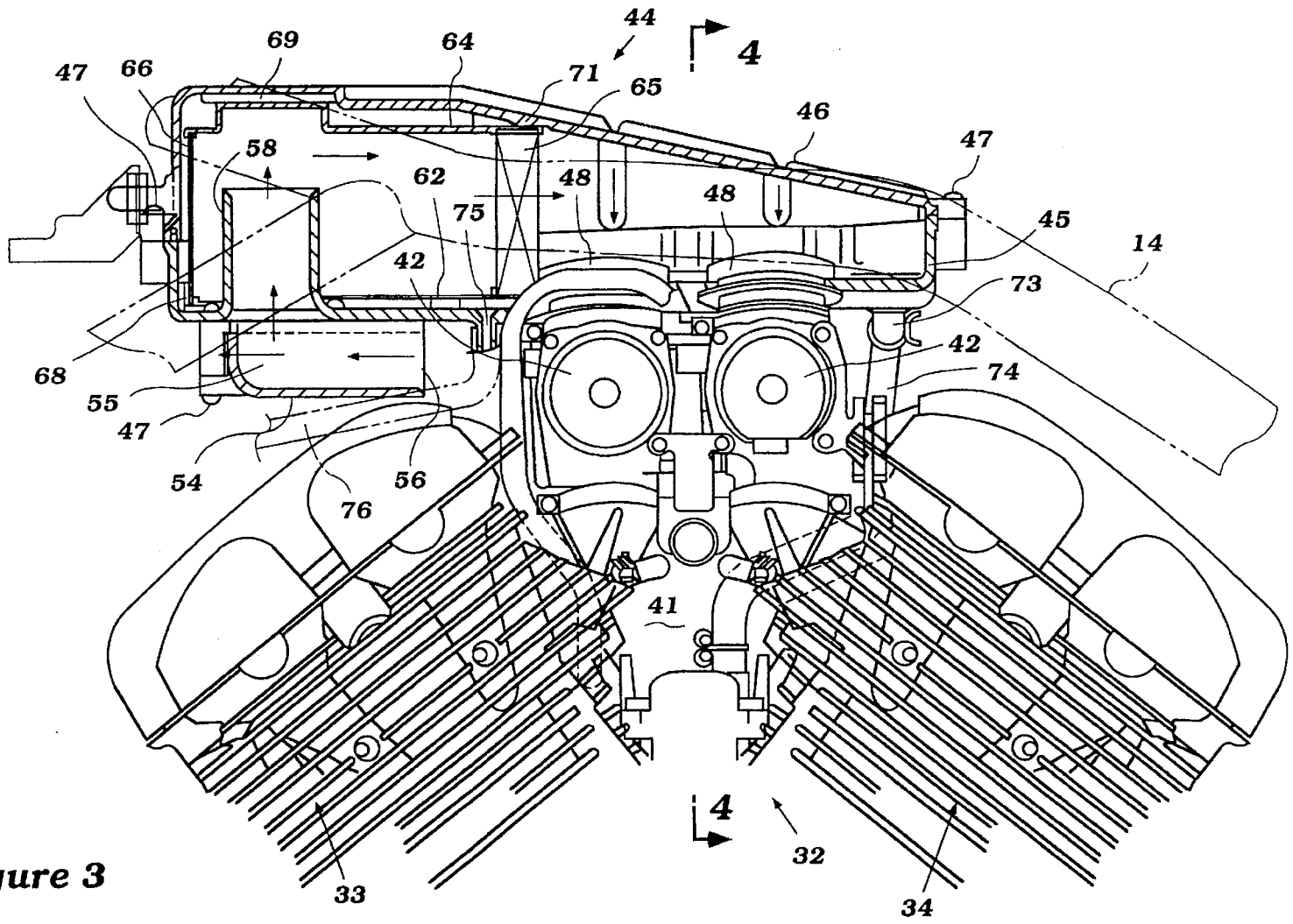
FIG. 3 is an enlarged side elevational view looking in the same direction as FIG. 1 and shows the air inlet device in cross section.
Figure 4:
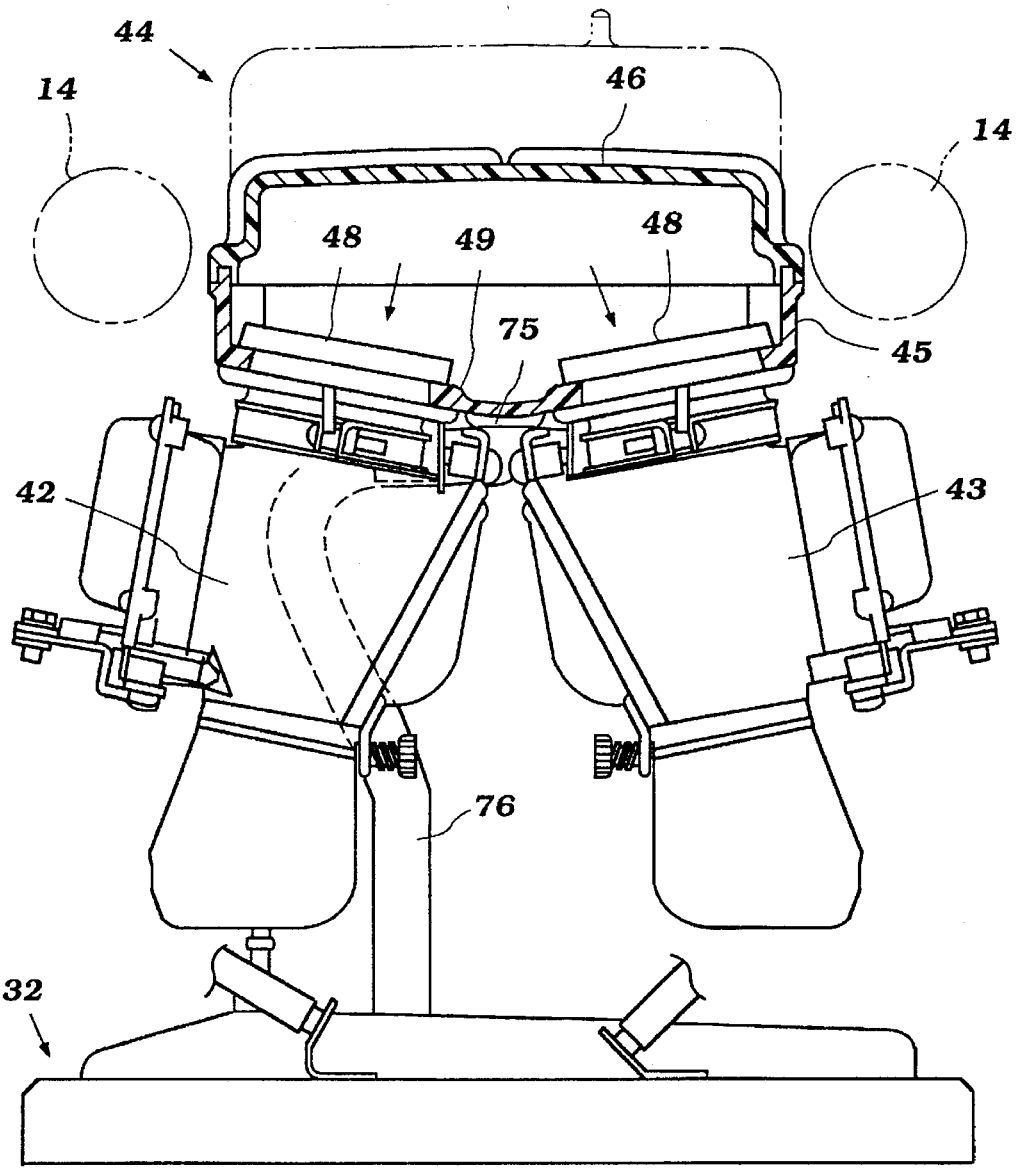
FIG. 4 is a cross-sectional view taken along the line 4—4 of FIG. 3 and illustrates the air inlet device in section.
Figure 5:
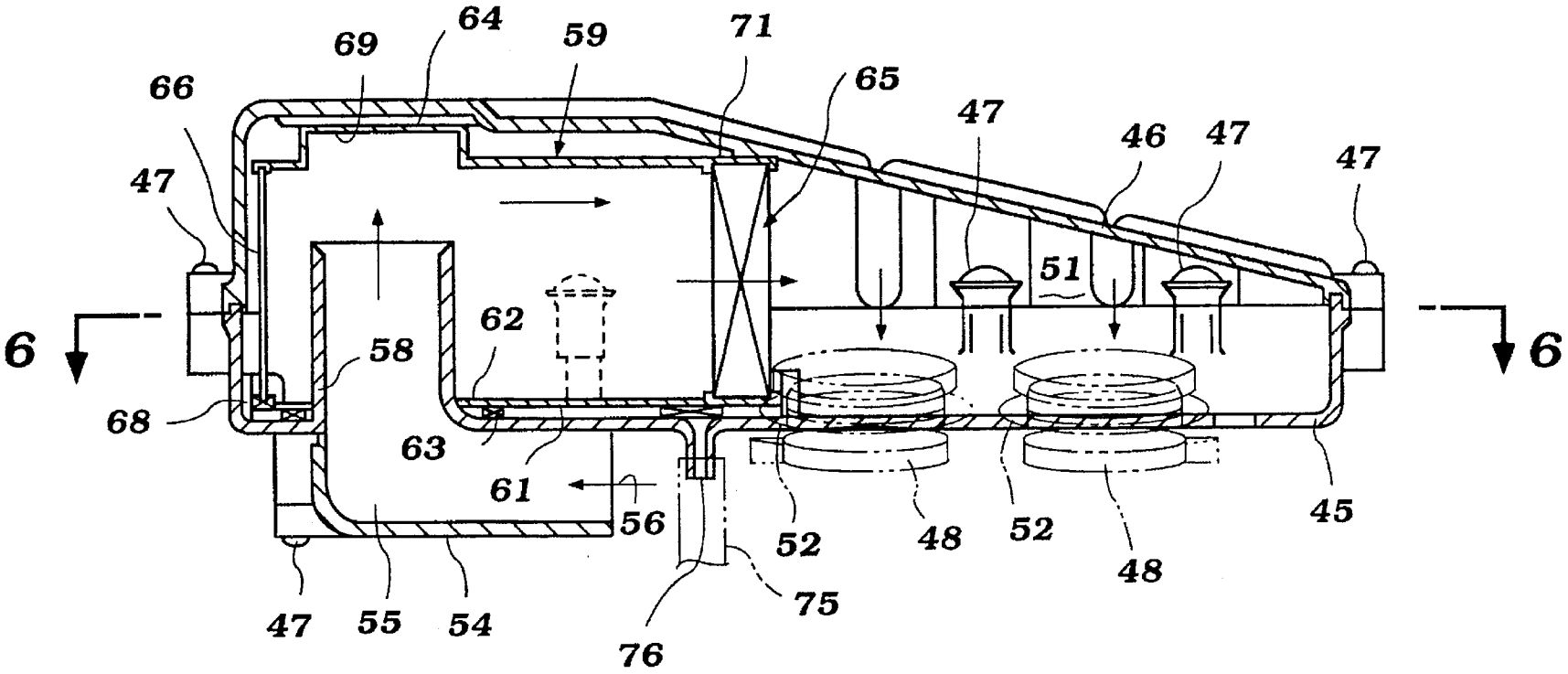
FIG. 5 is a longitudinal cross-sectional view of the air inlet device and looks generally in the same direction as FIG. 3.
Figure 6:
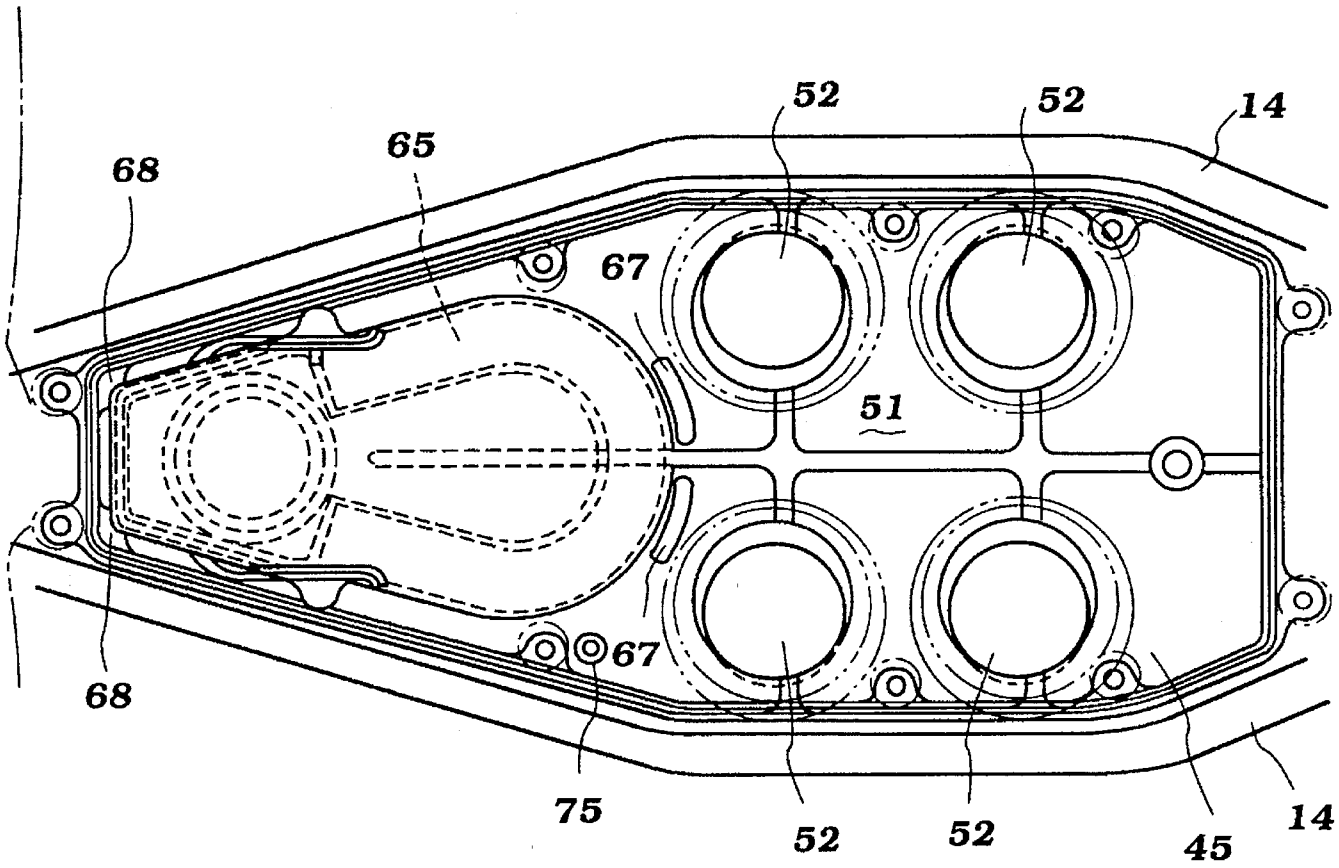
FIG. 6 is a top plan view of the air inlet device with the cover removed so as to more clearly show the internal construction of the air inlet device.

The engine 32 is also provided with a crankcase ventilation system wherein the crankcase gases are delivered to the interior of the air inlet device 44 downstream of the filter element 65. An inlet nipple 73 is formed in the lower wall in this area and receives a flexible hose 74 as seen in FIG. 3 for the return of the crankcase gases.

The lower wall is also formed with a drain nipple 75 which is formed in the inlet section below the filter element 65. A drain hose 76 is connected to this drain nipple 75 and drains in any condensed fluids to an appropriate location.

Thus, the described construction provides a very effective high volume filter element that can provide long servicing intervals even though the overall construction is extremely compact. Of course, the foregoing description is that of a preferred embodiment of the invention and various changes and modifications may be made without departing from the spirit and scope of the invention, as defined by the appended claims.

What is claimed is:

1. An air inlet device for an internal combustion engine, said engine having at least a pair of spaced apart inlet sections, said air inlet device being comprised of an outer housing defining an outlet section defined by a lower wall having a pair of spaced apart discharge openings for cooperation with said inlet sections for delivering air thereto, said lower wall being surrounded by an upstanding vertical wall defining a generally rectangular shape volume in top plan view, an air inlet opening formed in said air inlet device outer housing in spaced relationship to said outlet section for receiving atmospheric air, a filter element contained within said outer housing and having an arcuate filter section for dividing said inlet section from said outlet section for air flow through said filter element from said inlet section to said outlet section.

2. An air inlet device as set forth in claim 1, wherein the outer housing is formed by a detachable cover member that encloses and restrains the filter element.

3. An air inlet device as set forth in claim 2, wherein the air inlet opening is formed also in the outer housing lower wall.

4. An air inlet device as set forth in claim 3, wherein the inlet opening has a generally L-shaped configuration with a rearwardly facing atmospheric air inlet opening and an upwardly extending tubular section terminating within the inlet section of the outer housing.

5. An air inlet device as set forth in claim 4, wherein the inlet sections of the engine are inclined at an angle to a vertical plane and the lower wall around the outlet section of the outer housing has a V-shaped configuration so as to extend perpendicularly to the engine inlet sections.

6. An air inlet device as set forth in claim 1, wherein the filter element has a generally horseshoe-shape.

7. An air inlet device as set forth in claim 6, wherein the open ends of the horseshoe shape of the filter element are closed by an imperforate wall that extends in close proximity to the interior of the outer housing.

8. An air inlet device as set forth in claim 7, wherein the outer housing is formed by a detachable cover member that encloses and restrains the filter element.

9. An air inlet device as set forth in claim 8, wherein the air inlet opening is formed also in the outer housing lower wall.

10. An air inlet device as set forth in claim 9, wherein the inlet opening has a generally L-shaped configuration with a rearwardly facing atmospheric air inlet opening and an upwardly extending tubular section terminating within the inlet section of the outer housing.

11. An air inlet device as set forth in claim 10, wherein the inlet sections of the engine are inclined at an angle to a vertical plane and the lower wall around the outlet section of the outer housing has a V-shaped configuration so as to extend perpendicularly to the engine inlet sections.

12. An air inlet device as set forth in claim 1, wherein there are two pair of spaced apart inlet sections for the engine.

13. An air inlet device as set forth in claim 12, wherein the outer housing is formed by a detachable cover member that encloses and restrains the filter element.

14. An air inlet device as set forth in claim 13, wherein the air inlet opening is formed also in the outer housing lower wall.

15. An air inlet device as set forth in claim 14, wherein the inlet opening has a generally L-shaped configuration with a rearwardly facing atmospheric air inlet opening and an upwardly extending tubular section terminating within the inlet section of the outer housing.

16. An air inlet device as set forth in claim 15, wherein the inlet sections of the engine are inclined at an angle to a vertical plane and the lower wall around the outlet section of the outer housing has a V-shaped configuration so as to extend perpendicularly to the engine inlet sections.

17. An air inlet device as set forth in claim 12, wherein the filter element has a generally horseshoe-shape.

18. An air inlet device as set forth in claim 17, wherein the open ends of the horseshoe shape of the filter element are closed by an imperforate wall that extends in close proximity to the interior of the outer housing.

19. An air inlet device as set forth in claim 18, wherein the outer housing is formed by a detachable cover member that encloses and restrains the filter element.

20. An air inlet device as set forth in claim 19, wherein the air inlet opening is formed also in the outer housing lower wall.

21. An air inlet device as set forth in claim 20, wherein the inlet opening has a generally L-shaped configuration with a rearwardly facing atmospheric air inlet opening and an upwardly extending tubular section terminating within the inlet section of the outer housing.

22. An air inlet device as set forth in claim 21, wherein the inlet sections of the engine are inclined at an angle to a vertical plane and the lower wall around the outlet section of the outer housing has a V-shaped configuration so as to extend perpendicularly to the engine inlet sections.

* * * * *